US010238185B1

(12) United States Patent
Ong

(10) Patent No.: US 10,238,185 B1
(45) Date of Patent: Mar. 26, 2019

(54) ADJUSTMENT STRAP WITH QUICK CRIMP NIBS

(71) Applicant: LEAGUE OF INVESTORS, LLC, Garden Grove, CA (US)

(72) Inventor: Danny Ong, Westminster, CA (US)

(73) Assignee: LEAGUE OF INVESTORS, LLC, Garden Grove, CA (US)

( * ) Notice: Subject to any disclaimer, the term of this patent is extended or adjusted under 35 U.S.C. 154(b) by 0 days.

(21) Appl. No.: 15/732,888

(22) Filed: Jan. 16, 2018

Related U.S. Application Data

(63) Continuation-in-part of application No. 29/651,161, filed on Jan. 16, 2018, and a continuation-in-part of application No. 29/620,987, filed on Sep. 28, 2017.

(60) Provisional application No. 62/709,322, filed on Jan. 16, 2018, provisional application No. 62/707,083, filed on Oct. 23, 2017.

(51) Int. Cl.
*A44B 17/00* (2006.01)
*A42B 1/22* (2006.01)

(52) U.S. Cl.
CPC ..... *A44B 17/0058* (2013.01); *A44B 17/0023* (2013.01); *A44B 17/0041* (2013.01); *A42B 1/22* (2013.01); *A44B 17/0029* (2013.01)

(58) Field of Classification Search
CPC ..... A42B 1/22; A42B 3/145; A44B 11/20; A44B 99/005; A44B 11/22; A44B 17/0058; A44B 17/0041; A44B 17/0023; A44B 17/0029
See application file for complete search history.

(56) References Cited

U.S. PATENT DOCUMENTS 809,465 A 1/1906 Roy
3,192,589 A * 7/1965 Pearson ..... A44B 18/0053 24/16 PB
4,377,872 A 3/1983 Daniell, Jr.
4,520,533 A * 6/1985 Kasai ..... A41F 15/002 2/305
4,577,375 A 3/1986 Beaussant
4,640,287 A * 2/1987 Anderson ..... A44B 18/00 450/36
D299,380 S 1/1989 Wang
4,976,017 A 12/1990 Frano
5,272,772 A 12/1993 Hahn
5,581,850 A 12/1996 Acker
5,862,523 A 1/1999 Proctor
5,878,520 A 3/1999 Milbrandt et al.
D668,843 S * 10/2012 Lalonde ..... D2/881
D675,404 S * 2/2013 Parker ..... D2/882
8,650,665 B2 2/2014 Shirai
(Continued)

*Primary Examiner* — Khaled Annis
(74) *Attorney, Agent, or Firm* — Klein, O'Neill & Singh, LLP

(57) ABSTRACT

An adjustment strap with quick crimp nibs for a multitude of binding embodiments (such as backpacks, seatbelt fasteners, waist belts, hats etc.) is disclosed. The invention being comprised of two, rigid but slightly flexible, interlocking tabs made of, but not limited to, plastic, silicone compounds and the like. Said interlocking tabs being considered male and female components. Notches along the perimeter of said female tab having a triangular shape with a protruding ridge configured to receive proximally-facing teeth on the male tab. An object of the invention is to enhance the ability of a strap to maintain its interlocking strength during tension loads.

5 Claims, 2 Drawing Sheets

(56) References Cited

U.S. PATENT DOCUMENTS

| | | | | |
|---|---|---|---|---|
| 9,198,475 | B2 | 12/2015 | Park | |
| 9,198,483 | B2 * | 12/2015 | Adams | A44B 18/0007 |
| D753,905 | S | 4/2016 | Singleterry | |
| 9,392,846 | B2 | 7/2016 | Shirai | |
| D771,914 | S * | 11/2016 | Cho | D2/891 |
| 9,655,397 | B2 | 5/2017 | Cho | |
| 9,763,486 | B2 * | 9/2017 | Lacy | A42B 1/22 |
| 2004/0187191 | A1 | 9/2004 | Lee | |
| 2005/0115028 | A1 | 6/2005 | Cheung | |
| 2006/0096004 | A1 | 5/2006 | Friton | |
| 2008/0134414 | A1 * | 6/2008 | Cho | A42B 1/22 2/183 |
| 2009/0277938 | A1 | 11/2009 | Baron | |
| 2014/0053319 | A1 * | 2/2014 | Cho | A42B 1/248 2/209.13 |
| 2014/0101820 | A1 * | 4/2014 | Cho | A42B 1/22 2/171 |
| 2016/0353846 | A1 | 12/2016 | Zanghi | |
| 2017/0079362 | A1 * | 3/2017 | Olcese | A42B 1/22 |
| 2017/0182732 | A1 * | 6/2017 | Toronjo | B32B 3/266 |

* cited by examiner

ADJUSTMENT STRAP WITH QUICK CRIMP NIBS

FIELD OF THE INVENTION

The present invention generally relates to adjustable straps.

BACKGROUND

Straps have been in existence for centuries. Early humans with tools cut portions of animal hides into long strips for binding and carrying food stuffs and water jugs—many of these early straps were adjustable with bone and shell linkages. As metallurgy evolved, straps became stronger and adjustments more complex. Today adjustable straps continue to evolve with cutting edge textiles such as plastic and silicone compounds. U.S. Pat. No. 4,377,872A and 20160353846A1 granted to Danielle and Zanghhi respectively disclosed a latching strap having a multitude of interlocking, elliptical apertures. U.S. Patent No. 20090277938 granted to Baron teaches a binding band with a pin that interlocks with a corrugated slot. U.S. Patent Nos. 20050115028A1, U.S. Pat. No. 5,581,850A and U.S. Pat. No. 5,878,520A granted to Cheung, Acker and Milbrandt et. al. disclosed a tooth-shaped, interlocking tie strap with teeth that prevent the slotted portion from slipping. U.S. Pat. No. 9,655,397B2, U.S. Pat. No. D299,380S and 20040187191A1 granted to Cho, Lee and Wang respectively, disclosed hat straps with interlocking adjustment tabs. While many of the inventions in the prior art were found to have interlocking adjustable straps with teeth, none were found that included teeth that interlocked perpendicular to the longitudinal axis of the strap for enhanced tensile strength.

SUMMARY OF THE INVENTION

The device herein disclosed and described provides a solution to the shortcomings in the prior art through the disclosure of an adjustment strap with quick crimp nibs An object of the invention is to enhance the ability of a strap to maintain its interlocking strength during tension loads. The interlocking, teeth provide enhanced binding strength than Velcro™ and knots because they are positioned perpendicular to the strap's tensile load vectors.

Another object of this invention is to provide a means of enhancing the speed of installation, adjustment and disengagement of a strap. The toothed, crimp nibs allow for a user to quickly engage the straps by compressing and snapping the teeth together. Users can also quickly disengage the locking mechanism by simply peeling the tabs apart due to their flexible construction.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

An adjustment strap may comprise first and second parts 1, 2. Each of the first and second parts 1, 2 may define a first free edge 20, 24 and a second free edge 22, 26. The first part 1 may have a plurality of triangular teeth 7 arranged in two rows running along the first and second free edges 20, 22 of the first part 1. The second part 2 may have a plurality of triangular notches 6 arranged in two rows running along the first and second free edges 24, 26 of the second part 2. The notches 6 may extend out laterally to the first and second free edges 24, 26 so that an outer profile of the two rows of notches 7 of the second part mates and contact with an inner profile of the two rows of teeth 7 of the first part 1. A terminal end 28 of the first part 1 and a terminal end 30 of the second part 2 may both serve to attach the adjustment strap to an article of clothing.

BRIEF DESCRIPTION OF THE FIGURES

The accompanying drawings, which are incorporated herein and form a part of the specification, illustrate some, but not the only or exclusive, examples of embodiments and/or features.

Figure 2:
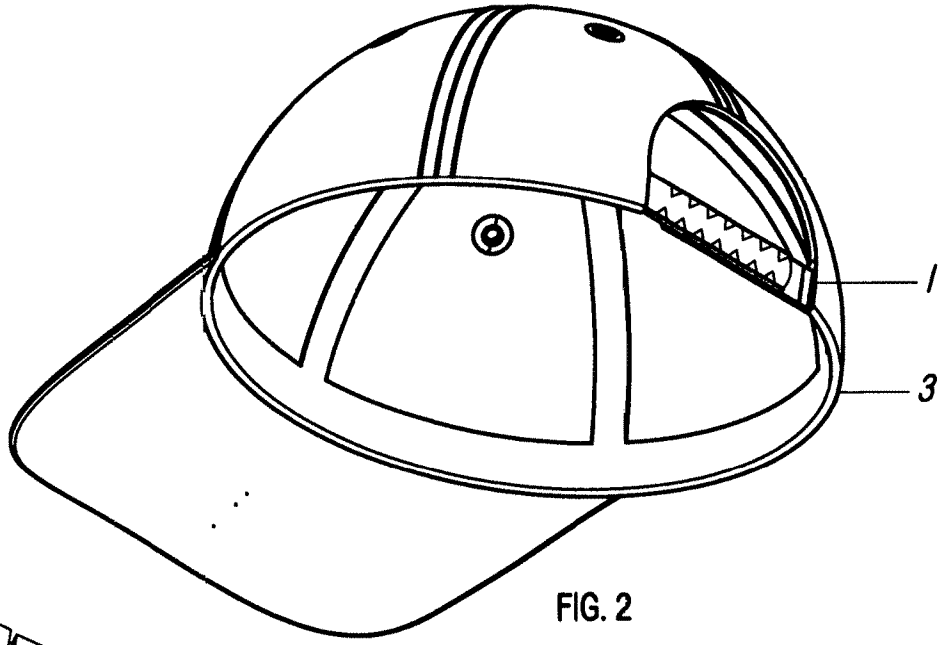
FIG. 2 showing a perspective view of an embodiment of the invention on a hat.

Other aspects of the present invention shall be more readily understood when considered in conjunction with the accompanying drawings, and the following detailed description, neither of which should be considered limiting.

DETAILED DESCRIPTION OF FIGURES

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
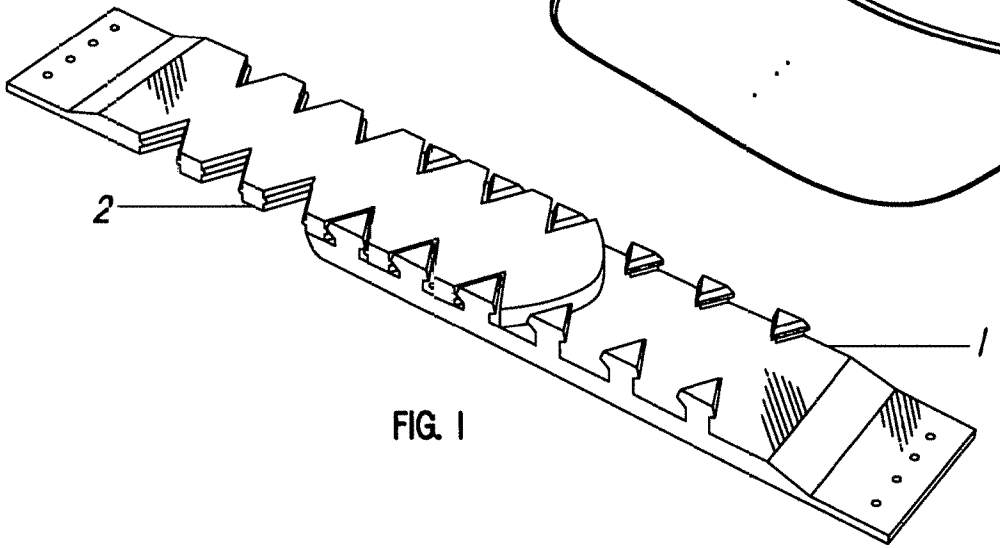
FIG. 1 shows a perspective view of the invention.

FIG. 1 showing a perspective view of the invention comprised of two interlocking parts made of, but not limited to, slightly flexible yet rigid materials such as plastics, rubber and silicone etc. Said parts comprised of a rectangular-shaped male crimp tab 1 and another rectangular-shaped female crimp tab 2.

FIG. 2 showing a perspective view of an embodiment of the invention on a hat. The interlocking portions being available to a user.

Figure 3:
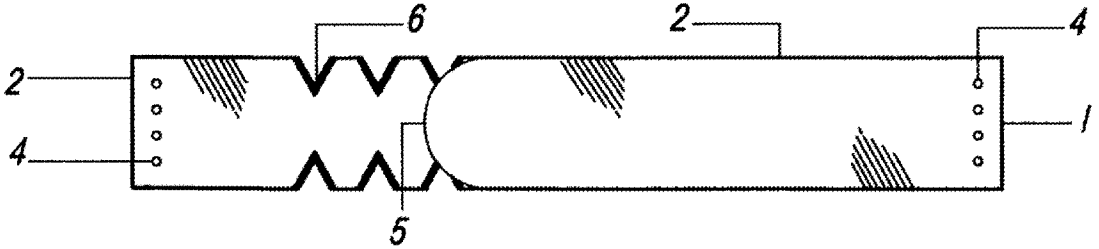
FIG. 3 shows a bottom view of the invention.

FIG. 3 shows a bottom view of the invention having said male crimp tab 1 and female crimp tab 2 being planar and rectangular shape with one end having a rounded terminus 5 and another end having a square terminus with a plurality of inline apertures 4 perpendicular to the longitudinal axis of said crimp tabs land 2 allowing a thread to pass through for affixing a varietal of external straps and the like.

Figure 4:
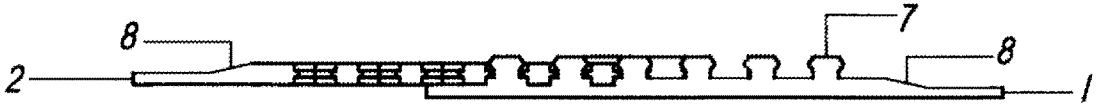
FIG. 4 showing a side view of the invention.

FIG. 4 showing a side view of the invention with said male crimp tab 1 and female crimp tab 2 having chamfered edges 8 on distal ends perpendicular to their longitudinal axes.

Figure 5:
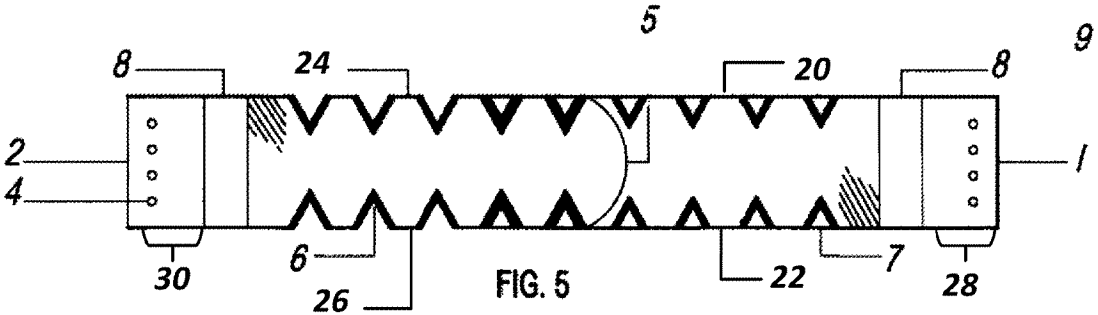
FIG. 5 illustrating a top view of the invention.

FIG. 5 illustrating a top view of the invention.

Figure 6:
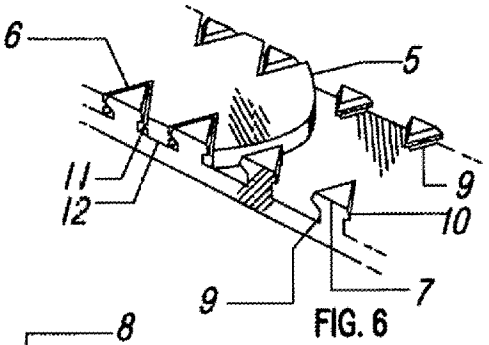
FIG. 6 illustrating a closeup perspective view of the invention.

FIG. 6 illustrating a closeup perspective view of the invention having a plurality of teeth 7 along its parallel edges with a triangular shape with apex facing proximal to said male crimp tab 1. Said teeth 7 having a ridge line 10 around its perimeter offset slightly larger than said triangle. The base of teeth 7 being affixed to male crimp tab 1 by means of another triangular protrusion 9. FIG. 6 also showing female crimp tab 2 having a plurality of teeth mate compartments 6 along its parallel edges comprised of notches to receive said teeth 7. Said teeth mate compartments 6 also having lip 11 allowing said ridge 10 to interlock.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

What is claimed is:

1. An adjustment strap comprising:

first and second parts, each of the first and second parts defining a first free edge and a second free edge;

the first part having a plurality of triangular teeth arranged in two rows running along the first and second free edges of the first part;

the second part having a plurality of triangular notches arranged in two rows abutting the first and second free edges of the second part wherein an outer profile of the two rows of notches of the second part mates and contact with an inner profile of the two rows of teeth of the first part, and the plurality of notches extend out laterally to the free edges to provide receptacles to receive the plurality of teeth of the first part as the first and second parts are being engaged to each other;

wherein a terminal end of the first part and a terminal end of the second part both serve to attach the adjustment strap to an article of clothing.

2. The adjustment strap wit nibs of claim 1 wherein each of the plurality of teeth has a ridge line and each of the plurality of notches have a lip to enhance the ability of the adjustment strap to maintain its interlocking strength during tension loads.

3. The adjustment strap of claim 1 wherein the triangular plurality of notches and the triangular plurality of teeth are inwardly directed to enhance the speed of installation, adjustment and disengagement of the first and second parts.

4. The adjustment strap of claim 1 wherein the first and second parts are fabricated from at least one of plastic, rubber and silicone.

5. The adjustment strap of claim 1 wherein the ridge line of the plurality of teeth is disposed above the lip of the plurality of notches when the first and second parts are interlocked.

* * * * *